US005979524A

United States Patent [19]

Trost

[11] Patent Number: 5,979,524

[45] Date of Patent: Nov. 9, 1999

[54] VENEER SLICER

[75] Inventor: Juergen F. Trost, Hanover, Canada

[73] Assignee: Danzer North America, Inc., Del.

[21] Appl. No.: 09/096,308

[22] Filed: Jun. 11, 1998

Related U.S. Application Data

[60] Provisional application No. 60/051,077, Jun. 27, 1997.

[51] Int. Cl.[6] ..... B27B 1/00; B27C 1/00

[52] U.S. Cl. ..... 144/357; 144/178; 144/212; 144/363; 364/474.02; 364/474.09

[58] Field of Search ..... 144/162.1, 178, 144/179, 356, 357, 212, 213, 214, 382, 365, 363; 364/474.02, 474.09

[56] References Cited

U.S. PATENT DOCUMENTS

| | | | |
|---|---|---|---|
| 2,576,520 | 11/1951 | Koss . | |
| 2,676,627 | 4/1954 | McFall | 144/178 |
| 3,441,069 | 4/1969 | Koss . | |
| 3,654,973 | 4/1972 | Koss | 144/178 |
| 3,680,612 | 8/1972 | Hale . | |
| 4,063,578 | 12/1977 | Cremona . | |
| 4,068,693 | 1/1978 | Cremona . | |
| 4,069,850 | 1/1978 | Cremona . | |
| 4,083,391 | 4/1978 | Cremona . | |
| 4,089,354 | 5/1978 | Cremona | 144/178 |
| 4,102,372 | 7/1978 | Cremona . | |
| 4,137,957 | 2/1979 | Cremona . | |
| 4,287,462 | 9/1981 | Beck et al. | 144/212 |
| 4,392,519 | 7/1983 | Calvert | 144/356 |
| 4,503,740 | 3/1985 | Brand et al. . | |
| 4,503,896 | 3/1985 | Brand . | |
| 4,587,616 | 5/1986 | Weil | 144/178 |
| 4,601,317 | 7/1986 | Brand | 144/178 |
| 4,753,278 | 6/1988 | Lorenzo | 144/212 |
| 4,791,970 | 12/1988 | Wasler et al. . | |
| 4,831,747 | 5/1989 | Roos et al. . | |
| 4,893,663 | 1/1990 | Ely . | |
| 5,067,534 | 11/1991 | Toivio . | |
| 5,101,874 | 4/1992 | Weil . | |
| 5,143,129 | 9/1992 | Toivio | 144/365 |
| 5,381,841 | 1/1995 | Weil . | |
| 5,383,504 | 1/1995 | Cremona . | |
| 5,385,185 | 1/1995 | Clavert | 144/357 |
| 5,452,220 | 9/1995 | Ely | 144/365 |
| 5,490,548 | 2/1996 | Puranen . | |
| 5,511,598 | 4/1996 | Brand . | |

FOREIGN PATENT DOCUMENTS

| | | |
|---|---|---|
| 1 204 985 | 5/1986 | Canada . |
| 25 01 936 | 1/1976 | Germany . |
| 25 23 481 | 5/1976 | Germany . |
| 25 23 482 | 5/1976 | Germany . |
| 39 15 516 A1 | 11/1989 | Germany . |
| 39 28 941 A1 | 3/1990 | Germany . |
| 1084683 | 5/1985 | Italy . |
| 1126371 | 5/1986 | Italy . |

*Primary Examiner*—W. Donald Bray
*Attorney, Agent, or Firm*—Barnes & Thornburg

[57] ABSTRACT

A veneer slicer comprises apparatus for reciprocating a flitch from which veneer is to be sliced, apparatus for supporting a knife for slicing veneer from the flitch as the flitch is reciprocated, and apparatus for supporting a pressure bar for contacting the flitch and exerting pressure on the flitch. The knife supporting apparatus and veneer reciprocating apparatus are movable relatively toward each other prior to a stroke of the flitch reciprocating apparatus during which the knife is in contact with the flitch to thereby remove a slice of veneer from the flitch. The apparatus for supporting the pressure bar is separately controllable from the knife supporting apparatus.

36 Claims, 3 Drawing Sheets

VENEER SLICER

TECHNICAL FIELD

This Appln claims benefit of Provisional Appln. No. 60/051,077 Jun. 27, 1997. This invention relates to improvements in veneer slicers. It is disclosed in the context of a conversion kit for an upstroke veneer slicer, but is believed to be useful in other applications as well.

BACKGROUND ART

Various types of veneer slicers are known. There are, for example, the veneer slicers illustrated and described in the following U.S. Pat. Nos.: 2,576,520; 2,676,627; 3,441,069; 3,654,973; 3,680,612; 4,063,578; 4,068,693; 4,069,850; 4,083,391; 4,089,354; 4,102,372; 4,137,957; 4,503,896; 4,587,616; 4,601,317; 5,381,841; and 5,511,598: Canadian Patent 1,204,985: and, Berman Patent Specifications: 2,501,936; and, 2,523,481. There are also the disclosures of U.S. Pat. Nos. 4,392,519; 4,503,740; 4,831,747; 4,893,663; 5,067,534; 5,101,874; 5,143,129; 5,383,504; and, 5,490,548: German Patent Specifications: 2,523,482; 3,915,516; and, 3,928,941: and, Italian Patent Specifications: 1,084,683; and, 1,126,371. No representation is intended by this listing that an exhaustive search of all pertinent prior art has been made or that no better art than that listed exists, and no such representation should be inferred. This listing does not constitute a representation that the material listed is pertinent, and no such representation should be inferred.

DISCLOSURE OF THE INVENTION

According to a first aspect of the invention, a veneer slicer and a method of operating a veneer slicer comprise apparatus for, and the steps of, reciprocating a flitch from which veneer is to be sliced, supporting a knife for slicing veneer from the flitch as the flitch is reciprocated, and for supporting a pressure bar for contacting the flitch and exerting pressure on the flitch. The knife supporting apparatus and veneer reciprocating apparatus are movable relatively toward each other prior to a stroke of the flitch reciprocating apparatus during which the knife is in contact with the flitch to thereby remove a slice of veneer from the flitch. The apparatus for supporting the pressure bar is separately controllable from the knife supporting apparatus.

Illustratively according to this aspect of the invention, the flitch reciprocating apparatus reciprocates the flitch generally vertically, and the stroke of the flitch reciprocating apparatus in which the knife is to contact the flitch and thereby removes a slice of veneer from the flitch is an upward stroke of the flitch reciprocating apparatus.

Further illustratively according to this aspect of the invention, the apparatus for, and the step of, supporting the pressure bar comprises providing a first end of the pressure bar adjacent a first end of the flitch and a second end adjacent a second end of the flitch, a first prime mover adjacent the first end of the apparatus for supporting the pressure bar, and a second prime mover adjacent the second end of the apparatus for supporting the pressure bar. The first and second prime movers exert first and second forces, respectively, on the first and second ends, respectively, of the apparatus for supporting the pressure bar, which exerts first and second pressures in response to the first and second forces, respectively, adjacent the first and second ends, respectively, of the flitch. A first circuit supplies motive power to the first prime mover. A second circuit supplies motive power to the second prime mover. A controller controls the first and second pressures.

Additionally illustratively according to this aspect of the invention, the knife has first and second ends remote from each other and the flitch has first and second ends remote from each other. The first and second ends of the knife extend beyond the first and second ends, respectively, of the flitch. The first and second ends of the knife experience forces tending to deflect the first and second ends of the knife as the knife contacts and removes a slice of veneer from the flitch. First and second sensors are positioned adjacent the first and second ends, respectively, of the knife to sense the tendency of the first and second ends, respectively, of the knife to deflect as the knife contacts and removes a slice of veneer from the flitch. Each of the first and second sensors includes an output port at which the respective sensor produces an output representative of the tendency of its respective end of the knife to deflect.

Further illustratively according to this aspect of the invention, the knife supporting apparatus and method provide a third prime mover for moving the knife supporting apparatus and the flitch supporting apparatus relatively toward one another prior to a stroke of the flitch reciprocating apparatus in which the knife is to contact the flitch and thereby remove a slice of veneer from the flitch.

Additionally illustratively according to this aspect of the invention, the prime movers comprise hydraulic motors.

According to another aspect of the invention, a veneer slicer and a method of operating a veneer slicer comprise apparatus for, and the steps of, reciprocating a flitch from which veneer is to be sliced, and supporting a knife for slicing veneer from the flitch as the flitch is reciprocated. The apparatus for, and steps of, supporting the knife and reciprocating the flitch provide movement of the knife and flitch relatively toward each other prior to a stroke of the flitch reciprocating apparatus during which the knife is to contact the flitch to remove a slice of veneer from the flitch. The knife has first and second ends remote from each other and the flitch has first and second ends remote from each other. The first and second ends of the knife extend beyond the first and second ends, respectively, of the flitch. The first and second ends of the knife experience forces tending to deflect the first and second ends of the knife as the knife contacts and removes a slice of veneer from the flitch. First and second sensors are positioned at the first and second ends, respectively, of the knife to sense the tendency of the first and second ends, respectively, of the knife to deflect as the knife contacts and removes a slice of veneer from the flitch. Each of the first and second sensors includes an output port at which the respective sensor produces an output representative of the tendency of its respective end of the knife to deflect.

According to this aspect of the invention, a memory is provided for accumulating the outputs of the first and second sensors.

Further according to this aspect of the invention, a processor is provided for processing the outputs of the first and second sensors and providing to an operator of the veneer slicer information pertaining to the operation of the veneer slicer.

BRIEF DESCRIPTION OF THE DRAWINGS

The invention may best be understood by referring to the following description and accompanying drawings which illustrate the invention. In the drawings.

MODES FOR CARRYING OUT THE INVENTION

Figure 1:
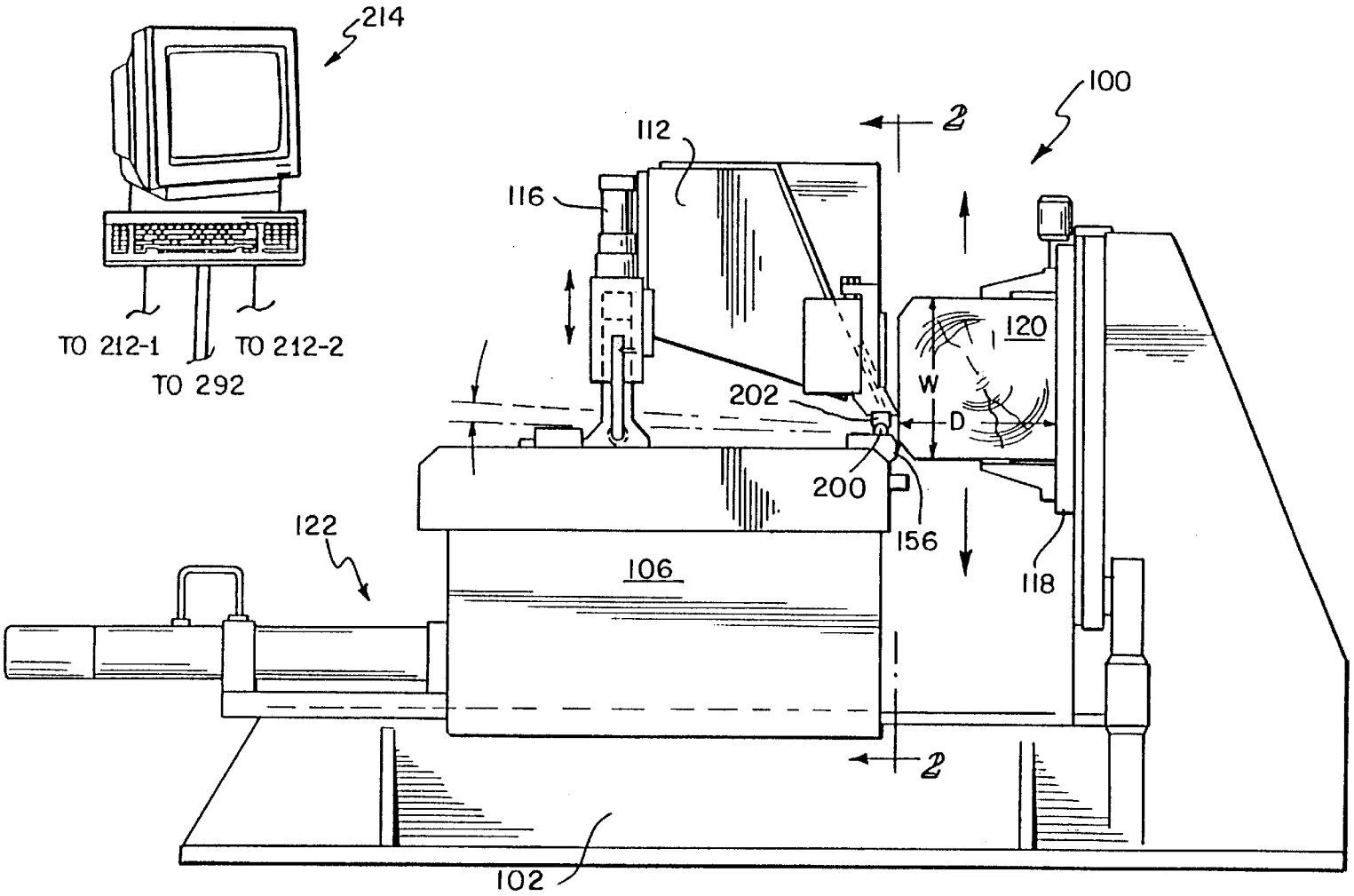
FIG. 1 illustrates a side elevational view of a veneer slicer incorporating apparatus according to the present invention.
Figure 2:
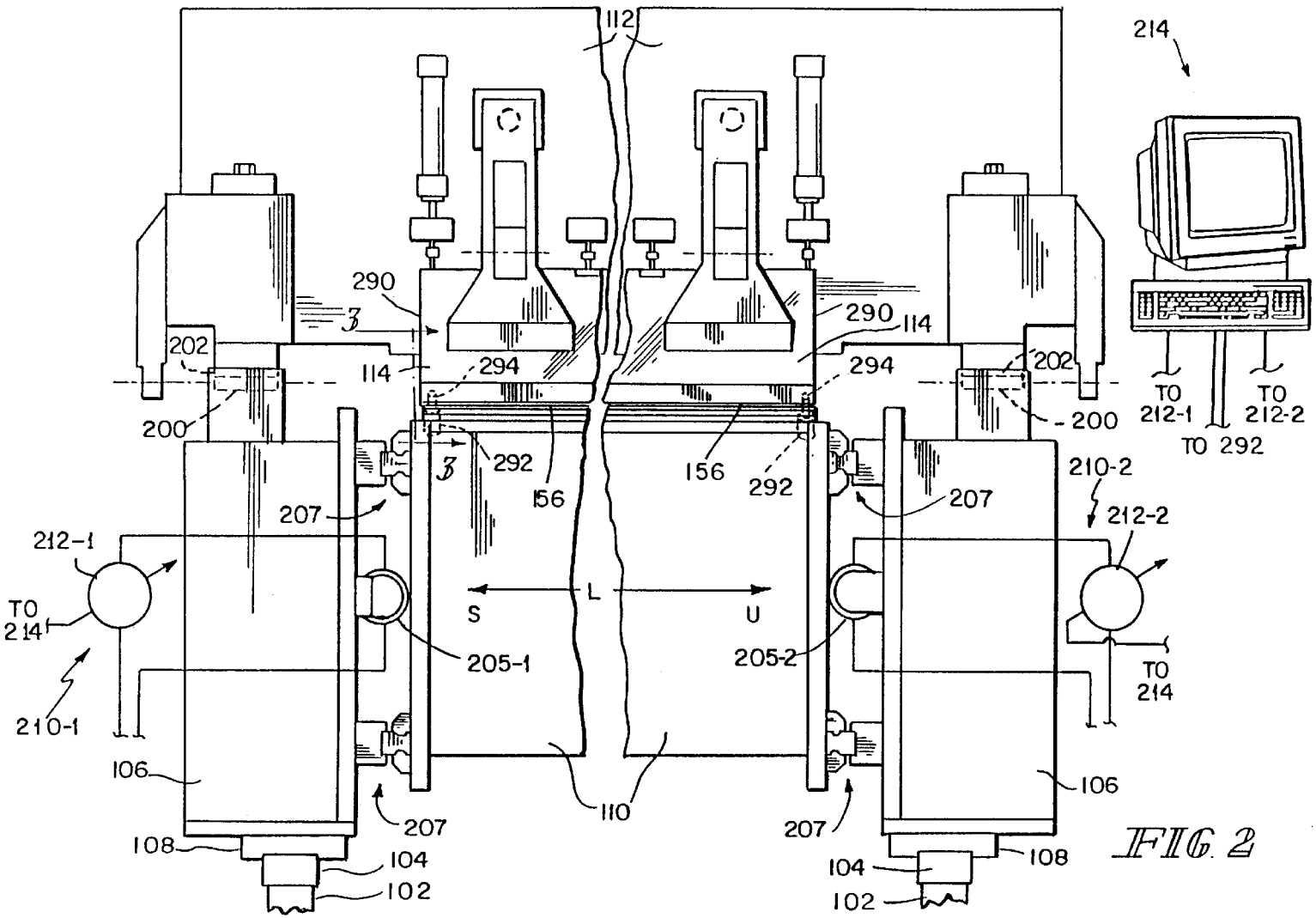
FIG. 2 illustrates a fragmentary sectional view, taken generally along section lines 2—2 thereof, of the veneer slicer illustrated in FIG. 1.
Figure 3:
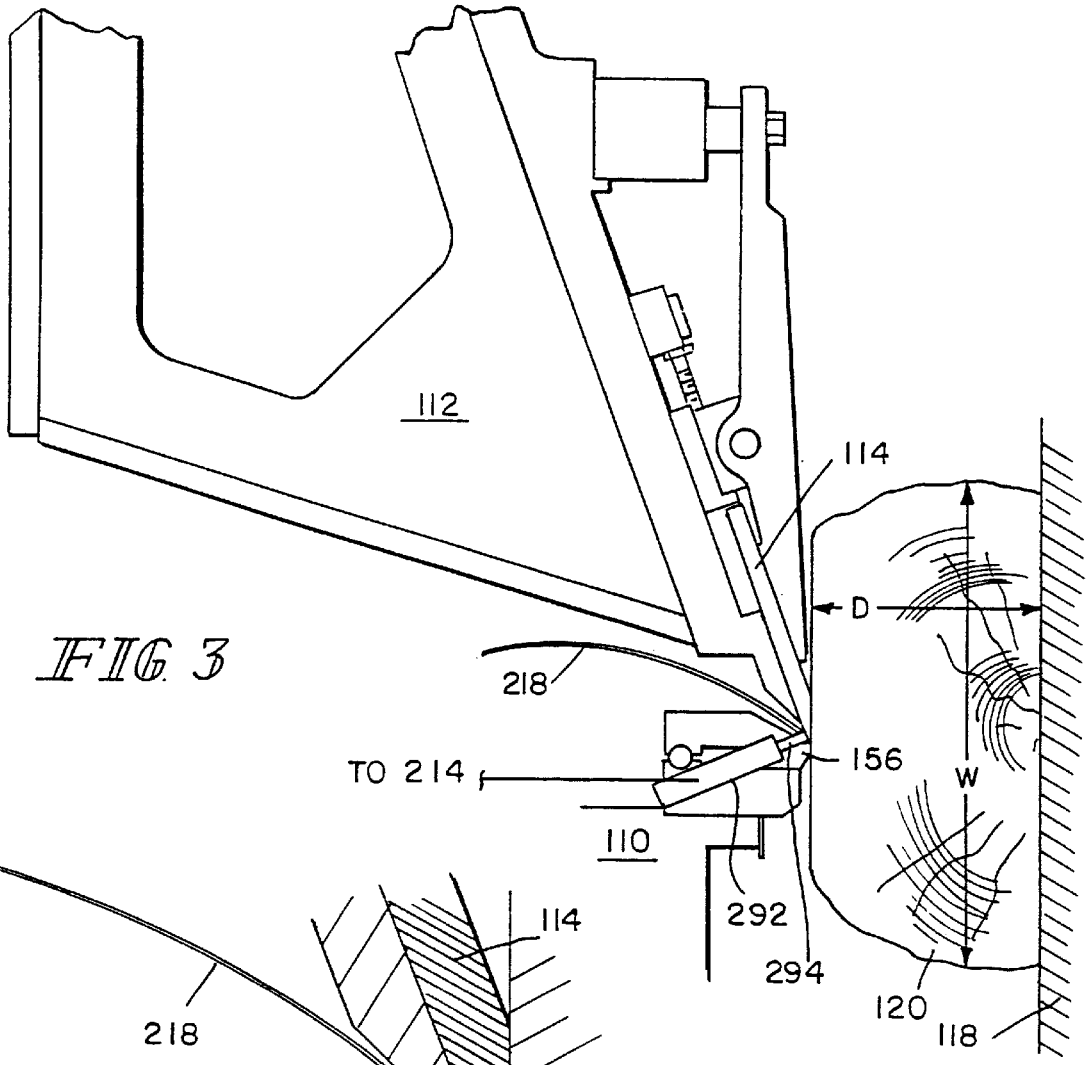
FIG. 3 illustrates an enlarged fragmentary side elevational view of a detail of the veneer slicer illustrated in FIG. 1; and, FIG. 4 illustrates a further enlarged fragmentary side elevational view of a detail of the veneer slicer illustrated in FIG. 3.
Figure 4:
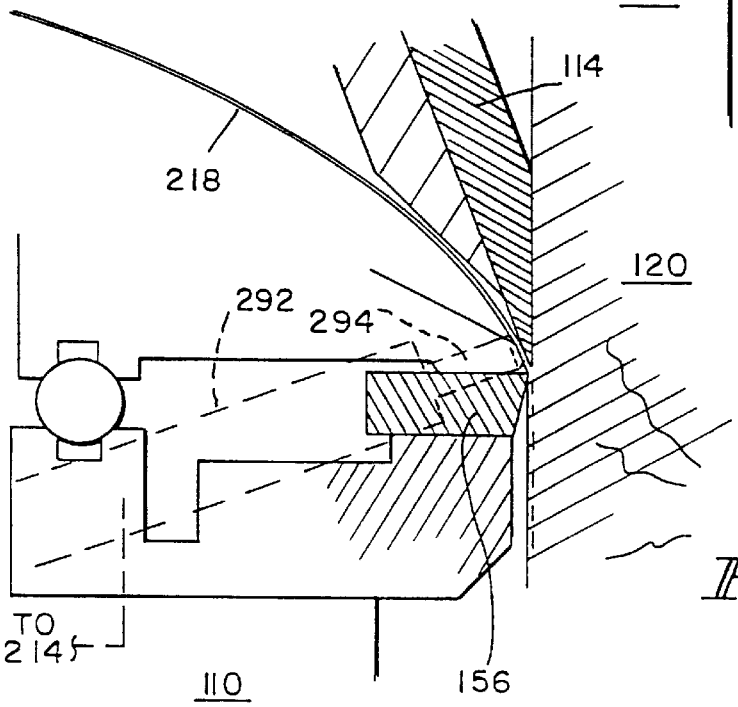

An upstroke veneer slicer 100 constructed according to the invention includes guide rails 102 at both of its lateral ends. Linear bearings 104 are mounted to respective right and left carriages 106 by carriage adapters 108. A pressure bar machining 110 is suspended between the right and left carriages 106. A knife bar machining 112 is pivotally mounted from the tops of the right and left carriages 106. Pivoting of the knife bar machining 112 and a knife 114 supported on machining 112 is achieved by actuation of knife angle cylinders 116 mounted between each of carriages 106 and their respective ends of the knife bar machining 112.

The right and left carriages 106 can be advanced forward toward, and retracted rearward away from, a flitch table 118 supporting a flitch 120 for slicing by any suitable drive assemblies 122, such as ball screw drive assemblies, linear positioners or any other suitable means for carefully controlling such motion, coupled to, and acting between, guide rails 102 and carriages 106. The illustrated drive assemblies 122 are linear positioners. Actuation of the linear positioners 122 drives the carriages 106 and the components supported by them toward and away from the flitch table 118.

The knife bar machining 112 is pivotally mounted from the carriages 106 by a support key 200 and pivot block 202. The support key 200 can be provided with a mechanism permitting the movement of the key 200 and the consequent adjustment of the knife gap, or the key can be mounted directly to the carriage 106. If the key 200 is to be mounted directly to the carriage 106, then linear bearings (not shown) are needed to mount the lower ends of knife angle cylinders 116 to their respective carriages 106 to accommodate the pivoting movement of knife bar machining 112 on support keys 200.

Fine adjustment of the gap between the knife 114 and a pressure bar 156 mounted on pressure bar machining 110 is made by actuation of motors 205-1 and 205-2 mounted on each of carriages 106 to move pressure bar machining 110 forward toward flitch table 118 or rearward away from flitch table 118 on linear bearings 207 by which pressure bar machining 110 is mounted on carriages 106. Separate motive power, for example, hydraulic fluid circuits 210-1 and 210-2, is provided for the motors 205-1 and 205-2, respectively. Separate regulators 212-1 and 212-2 are provided for circuits 210-1 and 210-2, respectively. Regulators 212-1 and 212-2 are under independent control from a controller 214 such as, for example, a programmed general purpose computer, which permits the pressures in fluid circuits 210-1 and 210-2 to be controlled independently from each other.

It is often the case when slicing a flitch 120 that the density of the wood across the length L of the flitch 120 varies. For example, one end S of the flitch is typically the stump end. This end S is typically somewhat more dense than the upper, or branch, end U of the flitch 120. It is also sometimes the case when slicing a flitch 120 that the density of the wood across the width W or depth D of the flitch 120 can vary. For example, if the tree from which the flitch 120 was obtained grew on a hillside, the density of the flitch 120 is known frequently to vary across the width W or depth D of the flitch 120. In such cases, algorithms can be developed to model the variations in the density of the wood of the flitch 120 along the length L of the flitch 120 or across the width W or depth D of the flitch 120 or some combination of these three. These algorithms can be used by the controller 214 to adjust the fluid pressures in circuits 210-1 and 210-2 independently so that the pressure bar 156 applies appropriate pressures across the length L of the flitch 120 or as the slicing of veneer 218 from the flitch 120 progresses, that is, across the width W or depth D of the flitch 120, or some combination of these, to promote the desired uniformity in characteristics of the veneer 218 sliced from the flitch 120.

The ends 290 of knife 114 extend beyond the ends of the flitch 120 from which veneer 218 is being sliced. The knife 114 is deflected slightly each time it is contacted by the flitch 120 as the flitch table 118 reciprocates the flitch 120 upward past the knife 114 and pressure bar 156. The condition, for example, the sharpness, of the knife 114 can be monitored by monitoring the deflection of the knife 114 that results from this contact. Any number of monitoring techniques can be employed for this purpose, such as, for example, LVDTs, laser measurement equipment, infrared measuring equipment, proximity transducers, and the like. In the illustrated embodiment, an LVDT 292 is mounted at each end of the pressure bar machining 110 beyond the end U, S of the flitch 120. The plungers 294 of the LVDTs 292 extend forward into contact with the back side of the knife 114 in the regions 290. The output signals for the LVDTs 292 are proportional to the deflection of the ends 290 of the knife 114. These signals can be analog-to-digital converted and processed and/or stored, for example, in the memory of the controller 214, to provide operational status information to the operator for use in controlling the slicer 100. For example, an algorithm with which the controller 214 is programmed can alert the operator of the veneer slicer 100 to the need to service the knife 114. Such an alert might include, for example, an indication to the operator that the knife 114 needs to be replaced by a sharpened knife and sharpened itself. Additionally, the data from the veneer slicer 100 operation can be accumulated over longer periods of time and correlated with the quality of the veneer being taken from slicer 100. This can provide valuable quality audit information which can be used in subsequent setup and operation of the slicer 100.

I claim:

1. A veneer slicer comprising apparatus for reciprocating a flitch from which veneer is to be sliced, apparatus for supporting a knife for slicing veneer from the flitch as the flitch is reciprocated, the knife supporting apparatus and veneer reciprocating apparatus being movable relatively toward each other prior to a stroke of the flitch reciprocating apparatus during which the knife is in contact with the flitch to remove a slice of veneer from the flitch, and apparatus for supporting a pressure bar for contacting the flitch and exerting pressure on the flitch, the pressure bar supporting apparatus being separately controllable from the knife supporting apparatus, the knife having first and second ends remote from each other and the flitch having first and second ends remote from each other, the first and second ends of the knife extending beyond the first and second ends, respectively, of the flitch, the first and second ends of the knife experiencing forces tending to deflect the first and second ends of the knife as the knife contacts and removes a slice of veneer from the flitch, and first and second sensors positioned adjacent the first and second ends, respectively, of the knife to sense the tendency of the first and second ends, respectively, of the knife to deflect as the knife contacts and removes a slice of veneer from the flitch, each of the first and second sensors including an output port at which the respective sensor produces an output representative of the tendency of its respective end of the knife to deflect.

2. The veneer slicer of claim I wherein the flitch reciprocating apparatus reciprocates the flitch generally vertically, and the stroke of the flitch reciprocating apparatus during which the knife is in contact with the flitch to remove a slice of veneer from the flitch is an upward stroke of the flitch reciprocating apparatus.

3. The apparatus of claim 1 or 2 wherein the apparatus for supporting the pressure bar for contacting the flitch and exerting pressure on the flitch comprises a first end adjacent a first end of the flitch and a second end adjacent a second end of the flitch, a first prime mover adjacent the first end of the apparatus for supporting the pressure bar, a second prime mover adjacent the second end of the apparatus for supporting the pressure bar, the first and second prime movers exerting first and second forces, respectively, on the first and second ends, respectively, of the apparatus for supporting the pressure bar which exerts first and second pressures in response to the first and second forces, respectively, adjacent the first and second ends, respectively, of the flitch, a first circuit for supplying motive power to the first prime mover, a second circuit for supplying motive power to the second prime mover, and a controller for controlling the first and second pressures.

4. The apparatus of claim 3 wherein the knife supporting apparatus comprises a third prime mover for moving the knife supporting apparatus and the flitch supporting apparatus relatively toward one another prior to a stroke of the flitch reciprocating apparatus during which the knife is to contact the flitch to remove a slice of veneer from the flitch.

5. The apparatus of claim 3 wherein the prime movers comprise hydraulic motors.

6. The apparatus of claim 4 wherein the prime movers comprise hydraulic motors.

7. The apparatus of claim 1 further comprising a memory for storing information related to the outputs of the first and second sensors.

8. The apparatus of claim 1 or 7 and further comprising a processor for processing information related to the outputs of the first and second sensors, and for providing to an operator of the veneer slicer information pertinent to the operation of the veneer slicer in response to the processed information.

9. The apparatus of claim 2 and further comprising a memory for storing information related to the outputs of the first and second sensors.

10. The apparatus of claim 9 and further comprising a processor for processing information related to the outputs of the first and second sensors, and for providing to an operator of the veneer slicer information pertinent to the operation of the veneer slicer in response to the processed information.

11. The apparatus of claim 3 and further comprising a memory for storing information related to the outputs of the first and second sensors.

12. The apparatus of claim 11 and further comprising a processor for processing information related to the outputs of the first and second sensors, and for providing to an operator of the veneer slicer information pertinent to the operation of the veneer slicer in response to the processed information.

13. The apparatus of claim 4 and further comprising a memory for storing information related to the outputs of the first and second sensors.

14. The apparatus of claim 13 and further comprising a processor for processing information related to the outputs of the first and second sensors, and for providing to an operator of the veneer slicer information pertinent to the operation of the veneer slicer in response to the processed information.

15. The apparatus of claim 5 and further comprising a memory for storing information related to the outputs of the first and second sensors.

16. The apparatus of claim 15 and further comprising a processor for processing information related to the outputs of the first and second sensors, and for providing to an operator of the veneer slicer information pertinent to the operation of the veneer slicer in response to the processed information.

17. The apparatus of claim 6 and further comprising a memory for storing information related to the outputs of the first and second sensors.

18. The apparatus of claim 17 and further comprising a processor for processing information related to the outputs of the first and second sensors, and for providing to an operator of the veneer slicer information pertinent to the operation of the veneer slicer in response to the processed information.

19. A method of operating a veneer slicer comprising reciprocating a flitch from which veneer is to be sliced, supporting a knife for slicing veneer from the flitch as the flitch is reciprocated, moving the knife supporting apparatus and veneer reciprocating apparatus relatively toward each other prior to a stroke of the flitch reciprocating apparatus during which the knife is in contact with the flitch to remove a slice of veneer from the flitch, supporting a pressure bar for contacting the flitch and exerting pressure on the flitch, and separately controlling the knife supporting apparatus and the pressure bar supporting apparatus supporting the knife for slicing veneer from the flitch as the flitch is reciprocated comprising supporting a knife having first and second ends remote from each other and reciprocating the flitch comprising reciprocating a flitch having first and second ends remote from each other, the first and second ends of the knife extending beyond the first and second ends, respectively of the flitch, the first and second ends of the knife experiencing forces tending to deflect the first and second ends of the knife as the knife contacts and removes a slice of veneer from the flitch, positioning first and second sensors adjacent the first and second ends, respectively, of the knife to sense the tendency of the first and second ends, respectively, of the knife to deflect as the knife contacts and removes a slice of veneer from the flitch, and providing on each of the first and second sensors an output port at which the respective sensor produces an output representative of the tendency of its respective end of the knife to deflect.

20. The method of claim 19 wherein reciprocating the flitch comprises reciprocating the flitch generally vertically, and the stroke of the flitch reciprocating apparatus during which the knife is in contact with the flitch to remove a slice of veneer from the flitch is an upward stroke of the flitch reciprocating apparatus.

21. The method of claim 19 or 20 wherein supporting the pressure bar for contacting the flitch and exerting pressure on the flitch comprises supporting a first end of the pressure bar adjacent a first end of the flitch and supporting a second end of the pressure bar adjacent a second end of the flitch, providing a first prime mover adjacent the first end of the apparatus for supporting the pressure bar, providing a second prime mover adjacent the second end of the apparatus for supporting the pressure bar, exerting first and second forces, respectively, on the first and second ends, respectively, of the apparatus for supporting the pressure bar with the first and second prime movers, respectively, exerting first and second pressures in response to the first and second forces, respectively, adjacent the first and second ends, respectively, of the flitch, supplying motive power to the first prime mover through a first circuit, supplying motive power to the second prime mover through a second circuit, and independently controlling the first and second pressures.

22. The method of claim 21 wherein supporting the knife comprises providing a third prime mover for moving the knife and the flitch relatively toward one another prior to a stroke of the flitch reciprocating apparatus during which the knife is to contact the flitch to remove a slice of veneer from the flitch.

23. The method of claim 21 wherein providing prime movers comprises providing hydraulic motors.

24. The method of claim 22 wherein providing prime movers comprises providing hydraulic motors.

25. The method of claim 19 and further comprising storing information related to the outputs of the first and second sensors in a memory.

26. The method of claim 19 or 25 and further comprising processing information related to the outputs of the first and second sensors using a processor, and providing to an operator of the veneer slicer information pertinent to the operation of the veneer slicer in response to the processed information.

27. The method of claim 20 and further comprising storing information related to the outputs of the first and second sensors in a memory.

28. The method of claim 27 and further comprising processing information related to the outputs of the first and second sensors using a processor, and providing to an operator of the veneer slicer information pertinent to the operation of the veneer slicer in response to the processed information.

29. The method of claim 21 and further comprising storing information related to the outputs of the first and second sensors in a memory.

30. The method of claim 29 and further comprising processing information related to the outputs of the first and second sensors using a processor, and providing to an operator of the veneer slicer information pertinent to the operation of the veneer slicer in response to the processed information.

31. The method of claim 22 and further comprising storing information related to the outputs of the first and second sensors in a memory.

32. The method of claim 31 and further comprising processing information related to the outputs of the first and second sensors using a processor, and providing to an operator of the veneer slicer information pertinent to the operation of the veneer slicer in response to the processed information.

33. The method of claim 23 and further comprising storing information related to the outputs of the first and second sensors in a memory.

34. The method of claim 33 and further comprising processing information related to the outputs of the first and second sensors using a processor, and providing to an operator of the veneer slicer information pertinent to the operation of the veneer slicer in response to the processed information.

35. The method of claim 24 and further comprising storing information related to the outputs of the first and second sensors in a memory.

36. The method of claim 35 and further comprising processing information related to the outputs of the first and second sensors using a processor, and providing to an operator of the veneer slicer information pertinent to the operation of the veneer slicer in response to the processed information.

* * * * *